United States Patent [19]

Johnson et al.

[11] 4,189,083

[45] Feb. 19, 1980

[54] LOW TEMPERATURE AND LOW COST ASSEMBLY PROCESS FOR NONLINEAR RESISTORS

[75] Inventors: Barry C. Johnson, Tempe; Vincent J. Pellechia, Scottsdale, both of Ariz.

[73] Assignee: Motorola, Inc., Schaumburg, Ill.

[21] Appl. No.: 916,325

[22] Filed: Jun. 15, 1978

[51] Int. Cl.[2] ..... H01B 1/08

[52] U.S. Cl. ..... 228/123; 228/124; 29/590; 29/628; 357/10

[58] Field of Search ..... 338/329; 29/612, 619, 29/621, 628, 590; 228/123, 124, 206, 211; 357/10

[56] References Cited

U.S. PATENT DOCUMENTS

| | | | |
|---|---|---|---|
| 2,169,098 | 8/1939 | Howe | 228/206 |
| 3,217,401 | 11/1965 | White | 228/123 |
| 3,503,029 | 3/1970 | Matsuoka | 29/612 |
| 3,810,068 | 5/1974 | DeLuca | 29/619 |

FOREIGN PATENT DOCUMENTS

| | | | |
|---|---|---|---|
| 51-10159 | 1/1976 | Japan | 228/206 |

*Primary Examiner*—Lowell A. Larson
*Attorney, Agent, or Firm*—Vincent B. Ingrassia

[57] ABSTRACT

A low cost two step process for attaching conductive leads and heat dissipating elements and for encapsulating a ceramic non-linear resistor pellet is described. Low temperature soldering techniques are utilized to assemble the device. Low temperature soldering is made feasible by the treatment of the attaching surfaces of the pellet with a dilute solution of acid for reducing the oxide surface to a pure metal in preparation for soldering.

8 Claims, 5 Drawing Figures

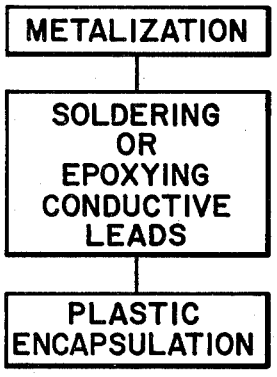
FIG. 1
(PRIOR ART)
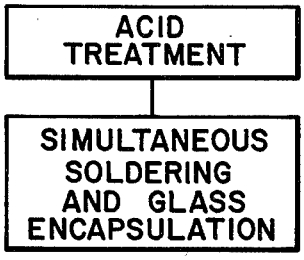
FIG. 2
FIG. 3
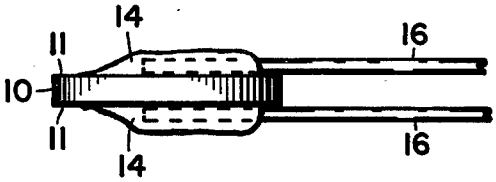
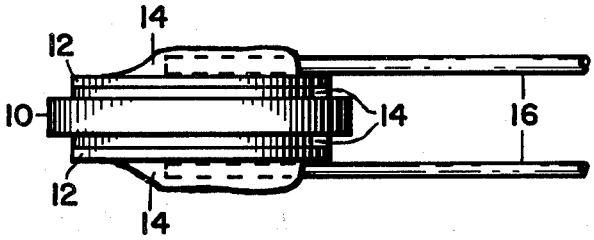
FIG. 4
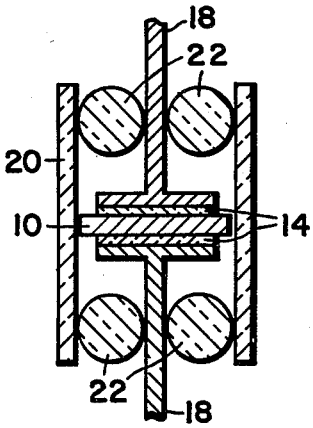
FIG. 5

LOW TEMPERATURE AND LOW COST ASSEMBLY PROCESS FOR NONLINEAR RESISTORS

FIELD OF THE INVENTION

The invention relates to a low cost, low temperature method for assembly of ceramic non-linear resistors such as varistors.

BACKGROUND OF THE INVENTION

In prior art methods for assembly of non-linear resistors a vacuum deposited titanium or chromium silver composite provides a metal surface on the pellet to which external leads are soldered or epoxy joined. Plastic encapsulation of the subassembly is then obtained by such means as a fluidized bed process. The prior art assembly process comprises three independent steps; (1) the metallization step, (2) the soldering or epoxy joining step and (3) the plastic encapsulation step. Since the assembly steps comprise a significant portion of the total cost of these devices, the semiconductor industry is constantly searching for means to reduce the assembly step complexity and, hence, the costs.

SUMMARY OF THE INVENTION

The goal of producing these parts at a lower cost is attained according to the instant invention by utilizing a relatively simple two step process. The non-linear resistor disc is preferentially treated with a dilute solution of hydrochloric acid to reduce the oxide surface to a pure metal. Conductive means may then be attached directly to this treated surface utilizing low temperature solders. This attaching or joining step may be combined with a glass encapsulation step to provide a completely fabricated device.

It is therefore an object of the invention to provide a simple two step process for assembly of non-linear resistor devices such as varistors.

It is another object of the invention to provide a low temperature solderable surface on a non-linear resistor device by means of preferentially treating the surface of the device with a dilute solution of hydrochloric acid.

It is still another object of the invention to provide a low cost non-linear resistor device by means of a single step process providing for attachment of conductive means and glass encapsulation simultaneously.

These and other objects of the invention will be more readily understood by reading the detailed description which follows together with the drawings in which:

FIG. 1 shows the flowchart steps of the prior art method of assembling non-linear resistor devices, FIG. 2 illustrates, in flowchart manner, the two step method of the invention for fabricating non-linear resistor devices, FIG. 3 is illustrative of a non-linear resistor device made according to the method of the invention, FIG. 4 is illustrative of another embodiment of a non-linear resistor device made according to the method of the invention, and FIG. 5 illustrates, in cross-section, an axial lead device prior to fusing of the parts.

DETAILED DESCRIPTION OF THE INVENTION

The preferred method of the invention embodies two method steps as shown in FIG. 2. In general, non-linear resistors, of the type with which the invention relates, are composed of a mixture of oxides of metals such as zinc and bismuth ($ZnO$ and $Bi_2O_3$). According to the method of the invention a dilute solution of an acid such as hydrochloric acid, which may be typically in the range of 10 to 35 percent, is used to preferentially reduce the oxide at the surface of the non-linear resistor pellet leaving a mixture of pure metals such as zinc and bismuth. The chemical reactions which may possibly occur may be described as follows:

$$ZnO+2HCl_2 \rightarrow ZnCl_2+H_2O,\ ZnCl_2 \rightarrow Zn+Cl_2 \quad (1)$$

$$Bi_2O_3+6HCl \rightarrow 2BiCl_3+3H_2O,\ 2BiCl_3 \rightarrow 2Bi+3Cl_2 \quad (2)$$

These reactions produce zinc oxide and bismuth trioxide varistor pellets with thin surface layers of zinc and bismuth in the attaching zone.

The second step according to the method of the invention may incorporate both soldering and glass encapsulation simultaneously. Of course, glass or other encapsulation may be performed as a separate step if it is so desired. FIG. 3 shows an assembly according to the method of the invention. Pellet 10 is a mixture of oxides of metals forming the nonlinear resistor. This may be zinc oxide and bismuth trioxide for example. Pellet surfaces 11 are preferentially and selectively reduced by applying a dilute solution of an acid such as a 10 to 35 percent diluted solution of hydrochloric acid. The hydrochloric acid solution may be applied either manually or with automatic machinery. Solder 14 is then used to make a mechanical and electrical connection between wire 16 and metal surface 11. Solder 14 may be an alloy of 43 percent lead, 43 percent tin and 14 percent bismuth or alternately may be 95 percent lead, 5 percent tin. The temperature range for successful solder connections of this type is between 150° C. and 350° C. It will be understood that solder 14 may be of a preform type. FIG. 4 shows another embodiment of the assembled device made according to the method of the invention. Pellet 10 is treated with a dilute solution of hydrochloric acid as was done in the embodiment of FIG. 3. Planar heat disc 12, which may preferably be made of copper, is adhered to pellet 10 by means of solder 14. Wire 16 may be adhered to planar heat disc 12 by means of solder 14 also. Solder alloy 14 may be one of the same alloys as specified above. The assembly of pellet 10, discs 12 and wires 16 together with preform solder 14 may be accomplished simultaneously as a single step.

The assembly of FIG. 3 or FIG. 4 may be encapsulated with glass or plastic in an extra step. FIG. 5 is illustrative of a device made according to the method of the invention wherein encapsulation is incorporated with the soldering step. Pellet device 10 is assembled with header leads 18 and preform solder 14 inside of glass sleeve 20 with glass end seals 22 as shown in FIG. 5. This assembly is heated to the melting temperature of solder preforms 14 and glass 20 and 22 in a single step to provide the finished device. Solder preforms 14 are melted to fuse the metal parts 10, 18 and glass parts 20, 22 are also fused together in a single heating step. Of course header leads 18 may have headers of any desired size and shape for purposes of heat dissipation in the operating device. It may be advantageous in an assembly of the sort shown in FIG. 5 to use the higher end of the temperature range of from 150° C. to 350° C. for satisfactory results.

One of the advantages of the method described above is that much lower temperatures may be used for assembly than are used in the heat treating of the non-linear pellet element. The use of lead 18 (as shown in FIG. 5) with the large header has the advantage of providing good heat dissipation from pellet 10. Of course, a separate planar form heat dissipating disc such as that shown at 12 in FIG. 4 may also be used in the configuration of FIG. 5.

Various other modifications and changes may be made to the present invention from the principles of the invention described above without departing from the spirit and scope thereof as encompassed in the accompanying claims.

We claim:

1. A method for attaching conductive means to a ceramic non-linear resistor pellet comprising the steps of:

treating preferentially at least one surface of the ceramic pellet with a diluted solution of acid to reduce an oxide material at said surface; and soldering the conductive means to said surface with a solder material having a melting point in the range of from 150° C. to 350° C.

2. The method according to claim 1 wherein said solder material is a preformed material.

3. The method according to claim 1 wherein said solder material is approximately 43% lead, 43% tin and 14% bismuth.

4. The method according to claim 1 wherein said solder material is approximately 95% lead and 5% tin.

5. The method according to claim 1, 2 3 or 4 wherein said dilution of said solution of acid is hydrochloric acid in the range of between 10 and 35%.

6. The method according to claim 1, 2 3 or 4 wherein the conductive means comprises a planar form for improving heat dissipation from the pellet.

7. The method according to claim 1, 2 3 or 4 wherein the conductive means comprises:

planar means for improving heat dissipation from the pellet; and wire means for making an electrical connection, said wire means being soldered to said planar means in said soldering step.

8. The method according to claim 1, 2 3 or 4 wherein said soldering step includes the simultaneous encapsulation of the pellet and said conductive means.

* * * * *